US010889975B2

(12) United States Patent
Wulc

(10) Patent No.: US 10,889,975 B2
(45) Date of Patent: Jan. 12, 2021

(54) DRAIN PIPE DEBRIS REMOVER AND RELATED METHODS

(71) Applicant: Philip Charles Wulc, Yucaipa, CA (US)

(72) Inventor: Philip Charles Wulc, Yucaipa, CA (US)

( * ) Notice: Subject to any disclaimer, the term of this patent is extended or adjusted under 35 U.S.C. 154(b) by 456 days.

(21) Appl. No.: 15/051,429

(22) Filed: Feb. 23, 2016

(65) Prior Publication Data

US 2016/0244958 A1 Aug. 25, 2016

Related U.S. Application Data

(60) Provisional application No. 62/120,056, filed on Feb. 24, 2015.

(51) Int. Cl.

| | |
|---|---|
| ***E03F 9/00*** | (2006.01) |
| ***E03C 1/02*** | (2006.01) |
| ***E03C 1/30*** | (2006.01) |
| *E03C 1/302* | (2006.01) |

(52) U.S. Cl.

CPC ..... *E03F 9/005* (2013.01); *E03C 1/30* (2013.01); *E03C 1/302* (2013.01); *E03F 9/00* (2013.01)

(58) Field of Classification Search

None

See application file for complete search history.

(56) References Cited

U.S. PATENT DOCUMENTS

| | | | |
|---|---|---|---|
| 2,297,755 | A | 10/1942 | Faust |
| 2,608,421 | A | 8/1952 | Schnepp |
| 3,086,234 | A | 4/1963 | Crane |
| 3,268,937 | A | 8/1966 | Bollinger |
| 3,609,788 | A | 10/1971 | Mier |
| 3,727,261 | A | 4/1973 | Levine |
| 4,218,802 | A | 8/1980 | Babb et al. |
| 4,317,247 | A | 3/1982 | Levine |
| 4,364,140 | A | 12/1982 | Irwin |
| 4,570,281 | A | 2/1986 | Boelens |
| 4,763,374 | A | 8/1988 | Kaye |
| 4,774,739 | A | 10/1988 | Sherman, Jr. |
| 5,018,234 | A | 5/1991 | Meyer et al. |
| 5,265,301 | A | 11/1993 | Irwin |
| 5,497,514 | A | 3/1996 | Miller |
| 5,640,736 | A | 6/1997 | Salecker |
| 5,765,251 | A | 6/1998 | Jones |
| 5,769,960 | A | 6/1998 | Nirmel |
| 5,836,032 | A | 11/1998 | Hondo |
| 6,470,525 | B1 | 10/2002 | Silverman |
| 6,615,436 | B1 | 9/2003 | Burch, Jr. et al. |
| 6,775,873 | B2 | 8/2004 | Luoma |
| 6,920,663 | B2 | 7/2005 | Petit |
| 7,584,513 | B2 | 9/2009 | Turner |
| 7,610,635 | B2 | 11/2009 | Schultz et al. |

(Continued)

*Primary Examiner* — Mikhail Kornakov
*Assistant Examiner* — Pradhuman Parihar
(74) *Attorney, Agent, or Firm* — Buche & Associates, P.C.; John K. Buche; Bryce A. Johnson

(57) ABSTRACT

A drain pipe unclogging apparatus for clinging to and removing debris from a drain. The drain pipe unclogging apparatus is attached to a drill and can fit most electric and cordless battery powered drills. The drain pipe apparatus features a wire that is safe to the touch when the drain pipe apparatus is in use, yet still effective for clinging to and breaking apart debris.

4 Claims, 6 Drawing Sheets

(56) References Cited

U.S. PATENT DOCUMENTS

| | | | | |
|---|---|---|---|---|
| 8,434,186 | B2 | 5/2013 | Wildauer et al. | |
| 8,458,845 | B1 * | 6/2013 | Tabieros | A46B 5/0095 15/104.05 |
| 8,510,891 | B2 | 8/2013 | Fivecoate | |
| 8,745,771 | B2 | 6/2014 | Bates et al. | |
| 2007/0089254 | A1 * | 4/2007 | Alaine | B08B 9/043 15/104.33 |
| 2008/0179839 | A1 * | 7/2008 | Walters | B23B 31/008 279/51 |
| 2008/0276359 | A1 | 11/2008 | Morgan et al. | |
| 2008/0313831 | A1 | 12/2008 | Ovach et al. | |
| 2009/0293214 | A1 | 12/2009 | Ackerman et al. | |
| 2013/0019422 | A1 | 1/2013 | Miller et al. | |
| 2014/0215737 | A1 * | 8/2014 | Yu | B08B 9/045 15/104.33 |

* cited by examiner

DRAIN PIPE DEBRIS REMOVER AND RELATED METHODS

CROSS-REFERENCE TO RELATED APPLICATIONS

This application claims the benefit and priority of U.S. Provisional Application No. 62/120,056 filed Feb. 24, 2015, entitled "Drain pipe debris remover and related methods."

STATEMENT REGARDING FEDERALLY SPONSORED RESEARCH OR DEVELOPMENT

Not applicable.

BACKGROUND OF INVENTION

Field of the Invention

The subject matter of this specification is in the field of apparatus for unclogging drain pipes.

Background of the Invention

Drain pipe clogs are an issue in many homes and offices. One remedy for a clogged drain is achieved by manually navigating a drain snake through a drain in an attempt to break apart or pull out the debris that is clogging the drain. However, manually operating a drain snake may not produce enough force to cling onto and break apart debris. One option to generate more force is to attach a snake to an electric or cordless battery powered drill. A power drill allows a user to apply a greater rotational force to the snake than a hand could, and allows the snake to cling to or break apart debris as the snake is inserted into the drain.

Generally, drain snakes feature barbed edges, which if employed with a power drill may pose a safety hazard for a user if their skin contacts the barbed snake during use. Thus, a need exists for a barbless nylon wire snake, which is safer than a barbed snaked, and when used with a power drill, a nylon wire may be just as effective in clinging to debris or even breaking debris apart.

In sum, a need exists for a drain snake apparatus that can be attached to a power drill to generate more force and be safe to the touch when in operation.

SUMMARY OF THE INVENTION

In view of the foregoing, it is an object of the present invention to provide an improvement to apparatuses that remove debris from clogged pipes.

BRIEF DESCRIPTION OF THE FIGURES

The manner in which these objectives and other desirable characteristics can be obtained is explained in the following description and attached figure in which.

It is to be noted, however, that the appended figures illustrate only typical embodiments of the disclosed assemblies, and therefore, are not to be considered limiting in its scope, for the disclosed assemblies may admit to other equally effective embodiments that will be appreciated by those reasonably skilled in the relevant arts. Also, the figures are not necessarily made to scale.

DETAILED DESCRIPTION OF THE INVENTION

Generally, disclosed is an apparatus for unclogging drain pipes that attaches to most handheld electric and cordless battery powered drills.

Figure 1:
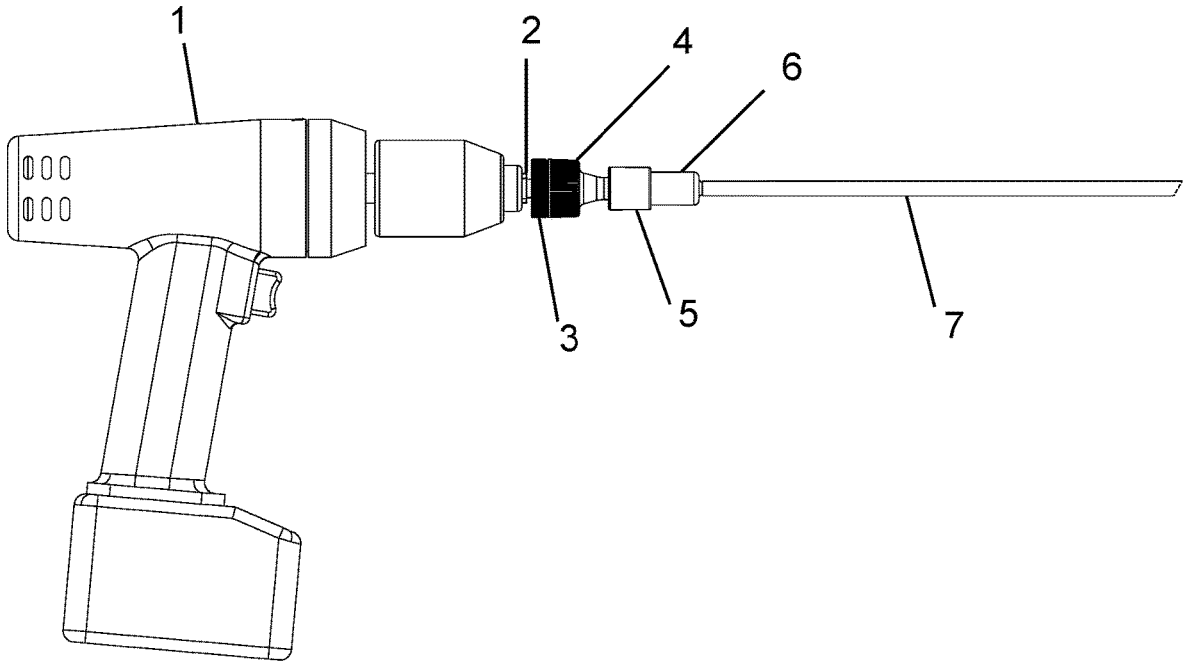
FIG. 1 is a perspective view of one embodiment of the drain pipe unclogger apparatus.

FIG. 1 is a perspective view of the drain pipe unclogging apparatus. Referring to FIG. 1, the drain pipe unclogging apparatus may feature a drill 1, a drill shank 2, a cap 3, a cam collar 4, a snap collar 5, a feed tip 6, and a tube 7.

Still referring to FIG. 1, the drain pipe unclogging apparatus features a drain pipe unclogger apparatus, wherein a drill shank 2 is inserted into the drill chuck of a drill 1. The drill shank 2 is coupled to a cap 3. In a preferred embodiment, the cap 3 receives a cam collar 4 and the cam collar 4 is coupled to a feed tip 6 via the support of a snap collar 5. The distal end of the feed tip 6 is coupled to a tube 7 and a wire 8 (see FIG. 2), which is fixed to the distal end of the feed tip 6 and disposed within the tube 7.

Figure 2:
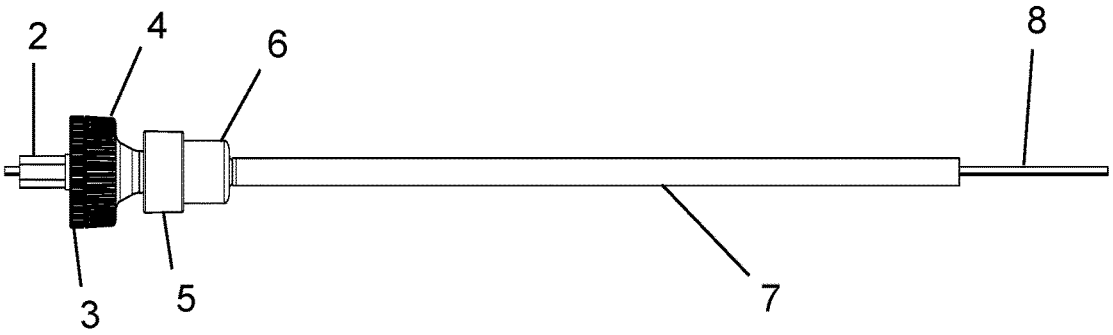
FIG. 2 is a side view of the drain pipe unclogger apparatus.

FIG. 2 is a side view of the drain pipe unclogger apparatus with a wire 8 disposed within a tube 7 and fixed to the feed tip 6. In a preferred embodiment, the wire 8 protrudes from the tube 7, so that the wire 8 can spin freely to grasp hair and debris or break apart debris.

Figure 3:
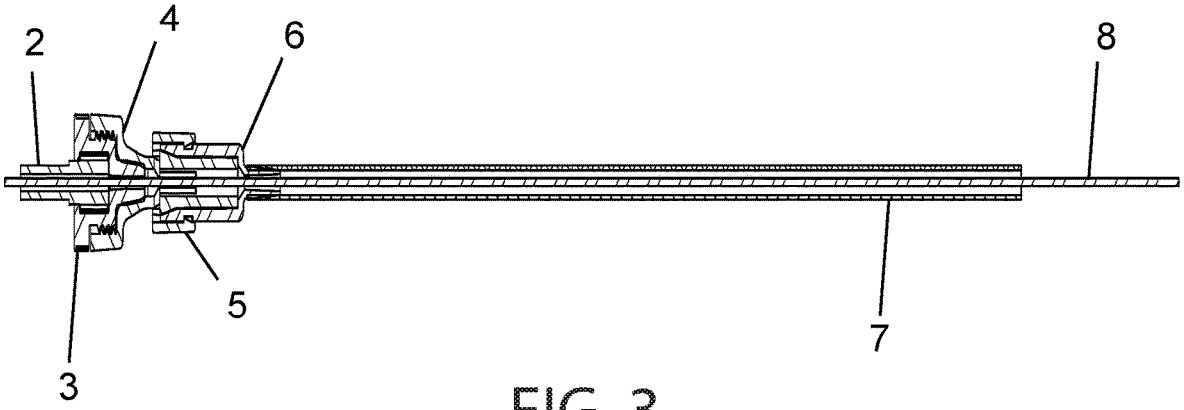
FIG. 3 is a cross-sectional view of the drain pipe unclogger apparatus.

FIG. 3 is a cross-sectional view of the drain pipe unclogger apparatus. Referring to FIG. 3, the drill shank 2 is inserted into the cap 3 and the cam collar 4 is threaded into the cap 3. A snap collar 5 is inserted onto the cap collar 4 via a snap-fit, wherein the feed tip 6 may be snapped into the snap collar 5.

Figure 4:
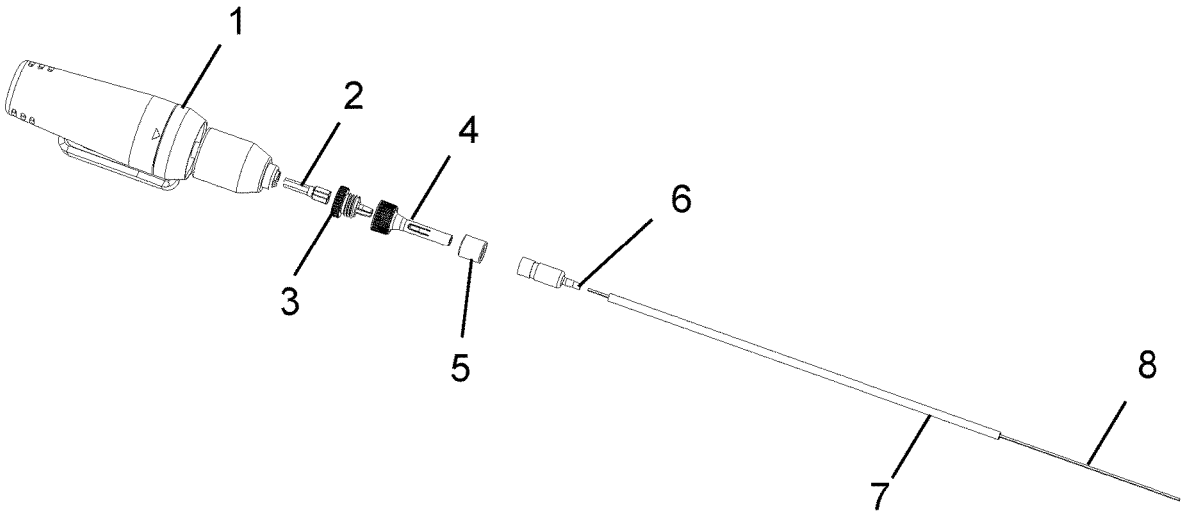
FIG. 4 is an exploded view of the drain pipe unclogger apparatus.

FIG. 4 is an exploded view of the drain pipe unclogger apparatus. Referring to FIG. 4, the drain unclogger apparatus, may be attached to most drills 1 via a drill shank 2. In a preferred embodiment, the wire 8 is composed of nylon. Using nylon is beneficial because when the drill 1 is powered on, the nylon wire 8 is safe to the touch and does not disrupt the surfaces of pipes, as opposed to a more rigid material such as metal. In a preferred embodiment, the wire may have a diameter of 0.050 inches to 0.110 inches.

Figure 5:
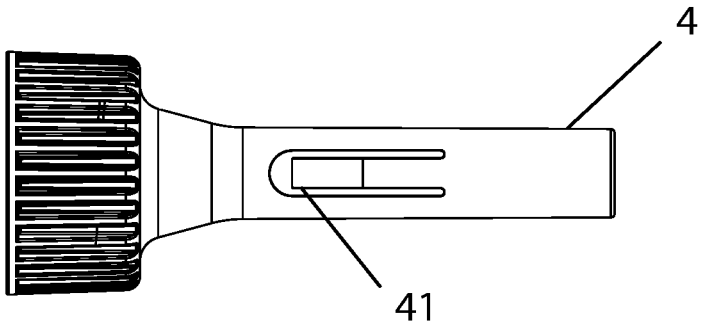
FIG. 5 is a side view of the cam collar of the drain pipe unclogger apparatus.

FIG. 5 is a side view of the cam collar 4 of the drain unclogger apparatus. The cam collar 4 may feature a protruding edge 41, which is designed to snap-fit into the snap collar 5.

Figure 6:
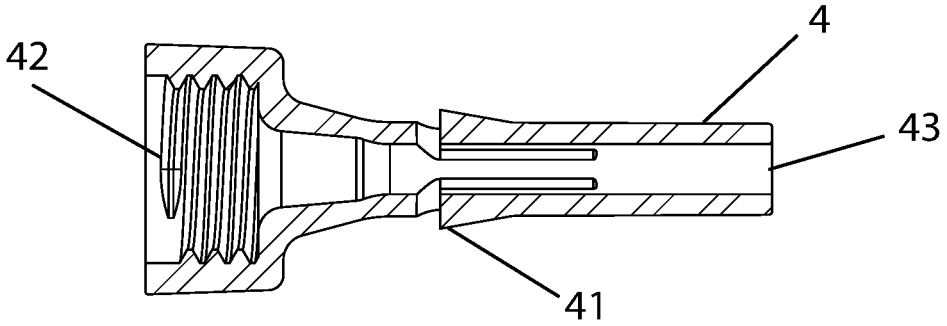
FIG. 6 is a cross-sectional view of the cam collar of the drain pipe unclogger apparatus.
Figure 7:
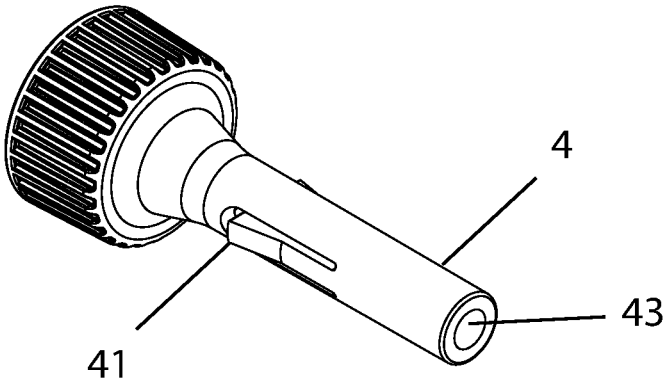
FIG. 7 is a perspective view of the cam collar of the drain pipe unclogger apparatus.

FIG. 6 is a cross-sectional view of the cam collar 4 of the drain unclogger apparatus and FIG. 7 is a perspective view of the cam collar 4 of the drain unclogger apparatus. In addition to the protruding edge 41, the cam collar 4 may also feature female threads 42 for the cap 3 to thread into the cam collar 4. The cam collar 4 provides a mechanism for the feed tip 6 to be fastened securely to the drain unclogger apparatus via a snap collar 5. The cam collar 4 may also feature a cam collar bore 43 that allows the wire 8 to pass through from the cap 3 to the feed tip 6.

Figure 8:
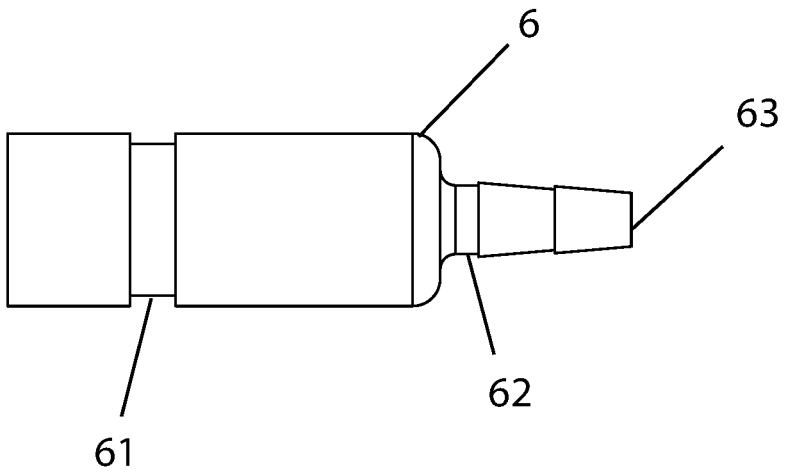
FIG. 8 is a side view of the feed tip of the drain pipe unclogger apparatus.
Figure 9:
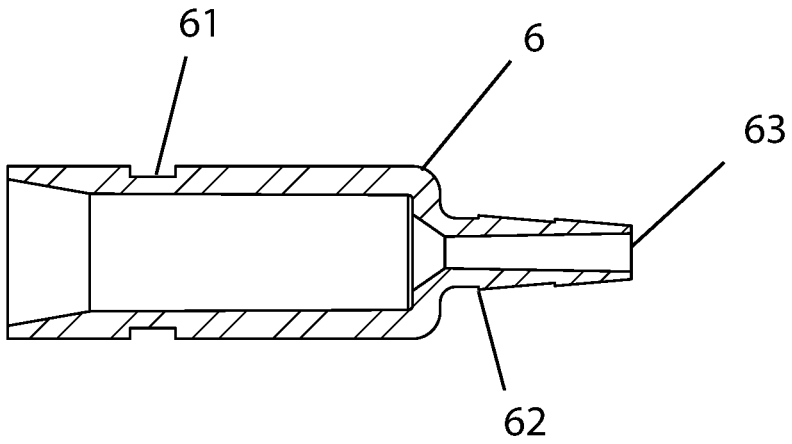
FIG. 9 is a cross-sectional view of the feed tip of the drain pipe unclogger apparatus.

FIG. 8 is a side view of the feed tip 6 and FIG. 9 is a cross-sectional view of the feed tip 6. In one embodiment, the feed tip 6 may have a recess 61 that provides a snap-in area for the snap collar 5 to snap into and couple the snap collar 5 with the feed tip 6. Thus, in one embodiment, once the snap collar 5 is snapped into the cam collar 4 and the feed tip 6, the snap collar 5 may securely connect the cam collar 4 with the feed tip 6. The feed tip 6 may also feature an indentation that allows the tube 7 to be securely attached to the feed tip 6. In one embodiment, the tube 7 may be snap-fitted onto the feed tip 6. The tube 7 may also be secured via an adhering substance, such as glue, or by any other adhering or fastening means known by one of skill in the art. Additionally, in one embodiment, the feed tip 6 may feature a feed tip bore 63, wherein a wire 8 may be inserted and threaded through the feed tip 6, through the cam collar 4 and into the cap 3. Accordingly, the wire 8 may extend from the end of the feed tip 6 and within the tube 7 that is coupled to the feed tip 6. The tube 7 offers support for a portion the wire 8 to aid in structure and to aid the user in directing and feeding the wire 8 through a drain. Moreover, the tube 7 confines spinning and rotation of the wire 8 to a coaxial position.

Figure 10:
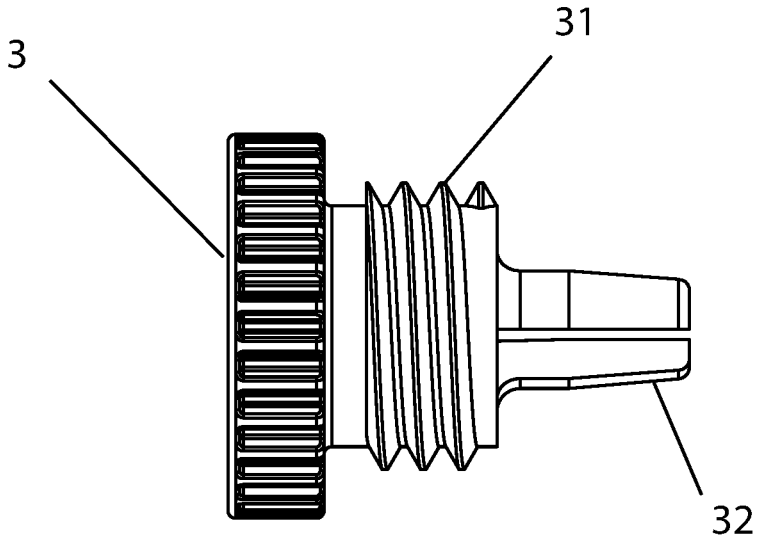
FIG. 10 is a side view of the cap of the drain pipe unclogger apparatus.

FIG. 10 is a side view of the cap 3 of the drain unclogger apparatus. In a preferred embodiment, the cap 3 features threads 31 which are screwed into the female threads 42 of the cam collar 4. The cap 3 may also feature prongs 32 that receive and secure the wire 8. In a preferred embodiment, there are 3 prongs 32 and when the cap 3 is screwed into the cam collar 4, the prongs 32 tighten around the wire 8.

Figure 11:
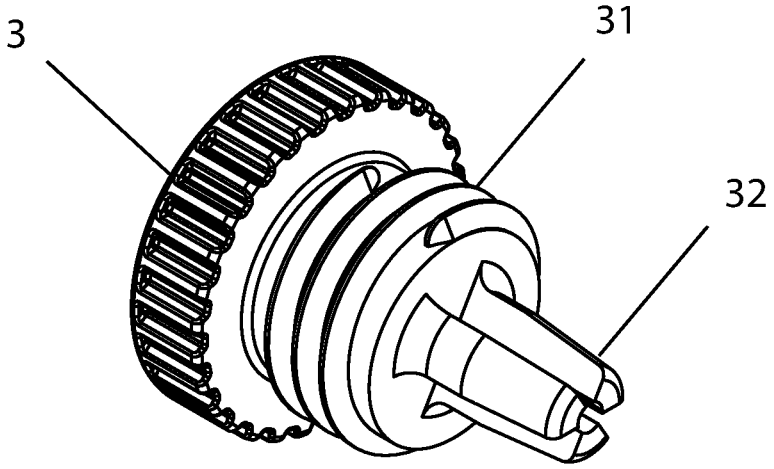
FIG. 11 is a perspective view of the cap of the drain pipe unclogger apparatus.

FIG. 11 is a perspective view of the cap 3 of the drain unclogger apparatus. In one embodiment, the cap 3 has a receptacle to receive the drill shank 2, wherein the drill shank 2 can connect the drain unclogger apparatus to a drill chuck. In a preferred embodiment, the wire 8 is secured in the prongs 32 of the cap 3 and passed through the cam collar 4 and the feed tip 6. In one embodiment, when the wire 8 is secured by the prongs 32 of the cap 3, the wire 8 is allowed to spin within the tube 7.

In use, a user will insert the drill unclogging apparatus into a drill chuck of a drill 1 by inserting the drill shank 2 into the drill chuck. In a preferred embodiment, the parts of drill unclogging apparatus are coupled or fastened to each other. In another embodiment, to assemble the drill unclogging apparatus, a user may insert one end of a drill shank 2 into a cap 3. The cap 3 may have a wire 8 inserted and secured into its prongs 32. A user may then pass the wire 8 through the cam collar 4 and screw the cap 3 into a cam collar 4, wherein the prongs 32 tighten against the wire 8. The cam collar 4 may be snap fit into a snap collar 5 and then the wire 8 may be passed through the feed tip 6 and tube 7. The feed tip 6, which has a tube 7 coupled to the end of it, may be snap-fit into the snap collar 5. With an assembled drill unclogging apparatus attached to a drill, the user feeds the wire 8 and, if necessary, the tube 7 down a drain. Once in the drain, the user turns the power drill on and the drill's chuck will cause the wire 8 to rotate and spin within the tube 7. The spinning action of the wire 8 enables the wire 8 to grasp or break apart debris in the drain, such as hair. Once the wire 8 grasps the debris, the user may pull out the wire 8 and the tube 7 from the drain with the debris on the end of the wire 8. In a preferred embodiment, when spinning, the wire 8 grasps hair and removes the hair that may have been clogging a drain.

In an alternative embodiment, the drain pipe apparatus may feature a wire reservoir, wherein extra wire 8 may be stored. In an alternative embodiment, the drain pipe apparatus may feature sets of different lengths of wire 8 that may be removed and inserted into the attachment.

In one embodiment, the drain pipe unclogging apparatus may be attached to, and used with, an electric drill. In an alternative embodiment, the drain pipe unclogging apparatus may be attached to, and used with, a cordless battery powered drill.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or ore of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

The claims filed herewith are incorporated by reference in their entirety into the specification as if fully set forth herein.

I claim:

1. A method of removing hair from a drain comprising:

obtaining a drill 1;

obtaining an apparatus for unclogging drains comprising:

a drill 1 attachment with a drill shank 2, a cap 3, a cam collar 4, a snap collar 5, a feed tip 6, a plastic tube 7, and a wire 8 coaxially positioned in the plastic tube 7;

wherein the apparatus for unclogging drains further comprises:

the drill shank 2 that is coaxially coupled to the cap 3, wherein the cap is defined by a threaded tip with three prongs 32;

the cam collar 4 with female threads 42 and a cam collar bore 43 with a protruding edge 41, wherein the threaded tip with three prongs 32 of the cap 3 is coaxially threaded into the cam collar 4;

the snap collar 5 that coaxially receives the cam collar bore 43, snaps over the protruding edge 41, and coaxially receives the feed tip 6, wherein the feed tip 6 has a recess 61 that allows it to snap into the snap collar 5 so that a feed tip bore 63 is presented at a distal end of the feed tip 6;

the tube 7 secured to the distal end of the feed tip 6 via an indentation; and, wherein the wire 8 is inserted into tube, through the feed tip bore 63, into the feed tip 6, through the snap collar 5, through the cam collar bore 43, into the cam collar, into the threaded tip between the three prongs 32, and into the drill shank, wherein the wire 8 is secured into the prongs 32 of the cap 3 by screwing the cap 3 into the cam collar 4 to tighten the three prongs 32 around the wire 8 so that the wire 8 is allowed to spin within the tube 7;

wherein the wire is passed through the cam collar 4 and the feed tip 6, wherein the wire 8 is disposed within the tube 7 and protrudes from the tube 7;

attaching the drill 1 attachment to the drill 1 by inserting the drill shank 2 into a chuck of the drill 1;

inserting the portion of the wire 8 that extends from the plastic tube 7 into the clogged drain;

directing and feeding the plastic tube 7 and wire 8 through the clogged drain while the plastic tube 7 supports a portion of the wire 8 disposed therein;

turning on the drill 1 to cause a spinning wire 8 that has rotation;

confining the spinning wire 8 and the wire's rotation to a coaxial position within the tube 7;

allowing the portion of wire 8 that is disposed in the plastic tube 7 and secured by the prongs 32 of the cap 3 to spin within the plastic tube 7 while the portion of the wire 8 that protrudes from the plastic tube 7 spins freely;

grasping hair with the spinning wire 8;

removing the wire 8, plastic tube 7 and grasped hair out of the drain;

turning the cap 3 to loosen the prongs 32 from the wire 8; and, removing the wire 8 from the plastic tube 7.

2. The method of claim 1, wherein the wire 8 has a diameter of a range between 0.050 inches and 0.110 inches.

3. The method of claim 2, wherein the wire 8 is composed of nylon.

4. The method of claim 3, wherein the wire 8 is 0.050-0.110 inches in diameter.

* * * * *